US007690542B1

(12) United States Patent
Silvera

(10) Patent No.: US 7,690,542 B1
(45) Date of Patent: Apr. 6, 2010

(54) DUAL-STRAP CARRYING CASE

(75) Inventor: Daniel Silvera, Manhattan Beach, CA (US)

(73) Assignee: Seychelles Imports, LLC, El Segundo, CA (US)

( * ) Notice: Subject to any disclaimer, the term of this patent is extended or adjusted under 35 U.S.C. 154(b) by 1331 days.

(21) Appl. No.: 11/153,521

(22) Filed: Jun. 14, 2005

(51) Int. Cl.
*A45F 5/00* (2006.01)
*A45C 13/30* (2006.01)

(52) U.S. Cl. ..... 224/579; 224/237; 224/665; 224/671; 224/675; 224/930

(58) Field of Classification Search ..... 224/578, 224/579, 665, 671, 676, 236, 237, 238, 239, 224/240, 930, 663, 666, 675, 250; D3/215, D3/218; 150/110, 118, 120; 383/15; 220/375
See application file for complete search history.

(56) References Cited

U.S. PATENT DOCUMENTS 2,346,185 A * 4/1944 Perry ..... 224/239
4,240,480 A * 12/1980 Strobel ..... 383/15
4,802,602 A * 2/1989 Evans et al. ..... 220/739
5,957,357 A * 9/1999 Kallman ..... 224/675
6,209,769 B1 * 4/2001 Seals et al. ..... 224/583
6,364,187 B1 * 4/2002 Castellano et al. ..... 224/675
D495,874 S * 9/2004 Kamiya ..... D3/218
D497,247 S * 10/2004 Kamiya ..... D3/218

FOREIGN PATENT DOCUMENTS

JP 2002112822 A * 4/2002

* cited by examiner

*Primary Examiner*—Nathan J Newhouse
*Assistant Examiner*—Steven M Landolfi, Jr.
(74) *Attorney, Agent, or Firm*—Joseph G. Swan, P.C.

(57) ABSTRACT

Provided is a carrying case that utilizes two straps, e.g., for looping over the top of a cellular telephone or similarly sized item. Attachment devices are located on the body of the carrying case, and in certain implementations often can provide flexibility in how the carrying case is configured and used.

20 Claims, 4 Drawing Sheets

DUAL-STRAP CARRYING CASE

BACKGROUND OF THE INVENTION

1. Field of the Invention

The present invention pertains to a dual-strap carrying case, and is particularly applicable to a small carrying case that may be used to hold a cellular telephone or similarly sized electronic device and that may be attached to a user's belt or other article of clothing.

2. Description of the Related Art

A variety of different cell-phone holders have been provided. However, each conventional cell-phone holder has its own disadvantages. For instance, certain cell-phone holders do not provide adequate access to the telephone. Others do not adequately secure the telephone within them. Still others rely on a tight fit to secure the telephone, raising the possibility of inadvertent depression of the telephone buttons.

SUMMARY OF THE INVENTION

The present invention addresses these conventional problems by providing a small carrying case that utilizes two straps to secure a telephone or other item.

Thus, in one aspect the invention is directed to carrying case that includes a small pouch (e.g., approximately 1½-3 inches wide and approximately 2-5 inches long), having a front side, a rear side, a left edge and a right edge. A first strap has a proximal end that is attached to the rear side of the pouch near the right edge and has a distal end that is provided with a first attachment means. A second strap has a proximal end that is attached to the rear side of the pouch near the left edge and has a distal end that is provided with a second attachment means. A third attachment means is disposed on the front side of the pouch near the right edge, and is for attaching to at least one of the first attachment means and the second attachment means. A fourth attachment means is disposed on the front side of the pouch near the left edge, and is for attaching to at least one of the first attachment means and the second attachment means. The various attachment means may include and/or utilize, e.g., snaps, hooks, clips, hook and loop materials, buttons or magnets.

A carrying case having the foregoing arrangement often can permit a user to appropriately secure and protect a cellular telephone or similarly sized device or item. At the same time, the user typically can be provided with easy access to the item.

In more particularized aspects of the invention: each of the first strap and the second strap is permanently attached to the pouch at its proximal end; each of the third attachment means and the fourth attachment means is disposed near a top edge of the pouch; each of the third attachment means and the fourth attachment means is capable of attaching to either of the first attachment means or the second attachment means (thereby permitting flexibility in using the carrying case); the first strap is angled so that its distal end naturally tends toward the front left edge of the pouch and the second strap is angled so that its distal end naturally tends toward the front right edge of the pouch (thereby providing, as a default, one of the more secure attachment configurations); a pocket is provided on the front side of the pouch; the first attachment means is identical to the second attachment means and the third attachment means is identical to the fourth attachment means; the pouch, the first strap and the second strap are all comprised of the same material; and/or additional attachment means are provided on the backside of the carrying case (thereby permitting additional flexibility in using the carrying case), e.g., directly beneath the proximal ends of the straps.

The foregoing summary is intended merely to provide a brief description of the general nature of the invention. A more complete understanding of the invention can be obtained by referring to the claims and the following detailed description of the preferred embodiments in connection with the accompanying figures.

DESCRIPTION OF THE PREFERRED EMBODIMENT(S)

Figure 1:
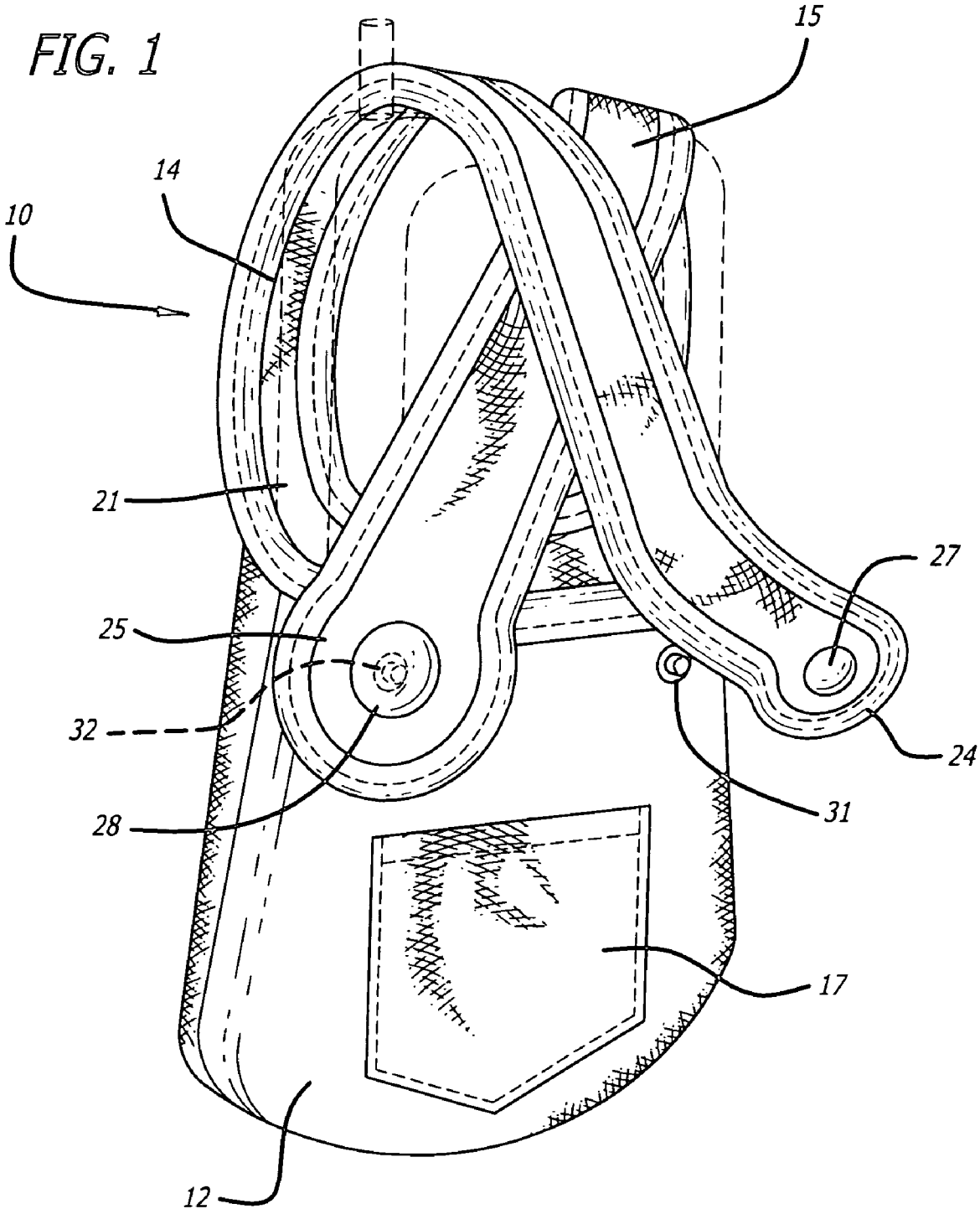
FIG. 1 is a front perspective view of a carrying case according to a representative embodiment of the present invention.

FIGS. 1-8 illustrate a carrying case 10 according to a representative embodiment of the present invention. As shown, carrying case 10 includes a pouch portion 12, which includes a top opening but otherwise preferably is closed, and two straps 14 and 15 that extend from the rear side of pouch 12 to its front side. Preferably, straps 14 and 15 are formed so as to naturally loop up above the top opening in pouch 12 and then come down for attachment to the front side of pouch 12. In the preferred embodiment of the invention, the front side of pouch 12 also is provided with a pocket 17 that is sewn onto pouch 12.

Preferably, pouch 12, strap 14 and strap 15 are fabricated from the same material. More preferably, straps 14 and 15 either are formed, together with at least a portion of pouch 12, as a unitary piece (as shown, e.g., in FIGS. 2 and 5) or are sewn onto pouch 12. In the preferred embodiments, carrying case 10 is made from a soft, pliable, water-proof fabric-like material. Pouch 12 preferably is approximately 1½-3 inches wide by approximately 2-5 inches long, and is able to accommodate an item of up to approximately ½-1½ inches thick. Straps 14 and 15 preferably are approximately 4-6 inches long and, more preferably, approximately 5 inches long, although the length of straps 14 and 15 may depend upon the length of pouch 12 (e.g., such that the combined length of carrying case 10 with straps 14 and 15 moved over and attaching in front is approximately the size of a typical cellphone). In any event, carrying case 10 preferably is sized just large enough to hold a variety of common cellular telephones, various personal digital assistants (PDAs), and/or any of a variety of other hand-sized items.

As noted above, in the present embodiment the proximal ends 21 and 22 of straps 14 and 15, respectively, are permanently attached to pouch 12. However, in other embodiments of the invention proximal ends 21 and 22 of straps 14 and 15 may be detachably attached to pouch 12, e.g., using snaps, using buttons or using hook and loop materials (such as is commonly sold under the trademark Velcro).

In any event, in the current embodiment of the invention the distal ends 24 and 25 of straps 14 and 15, respectively, are provided with snaps 27 and 28, respectively. However, in other embodiments either or both of snaps 27 and 28 may be replaced with hook material, loop material, a button, a buttonhole, a hook, a magnet or any other temporary attachment device.

Snaps 27 and 28 preferably are identical to each other and each may be attached to either of mating snaps 31 and 32 on the front side of pouch 12, with snaps 31 and 32 preferably being identical to each other. Of course, if snaps 27 and/or 28 are replaced with some other attachment device, snaps 31 and 32 preferably would be replaced with corresponding mating devices (e.g., loop material if snaps 27 and 28 are replaced with hook material).

Similarly, snaps 27 and 28 preferably each may be attached to either of optional mating snaps 35 and 36 on the rear side of pouch 12, with snaps 35 and 36 preferably being identical to each other. Once again, if snaps 27 and/or 28 are replaced with some other attachment device, snaps 35 and 36 preferably would be replaced with corresponding mating devices.

Figure 8:
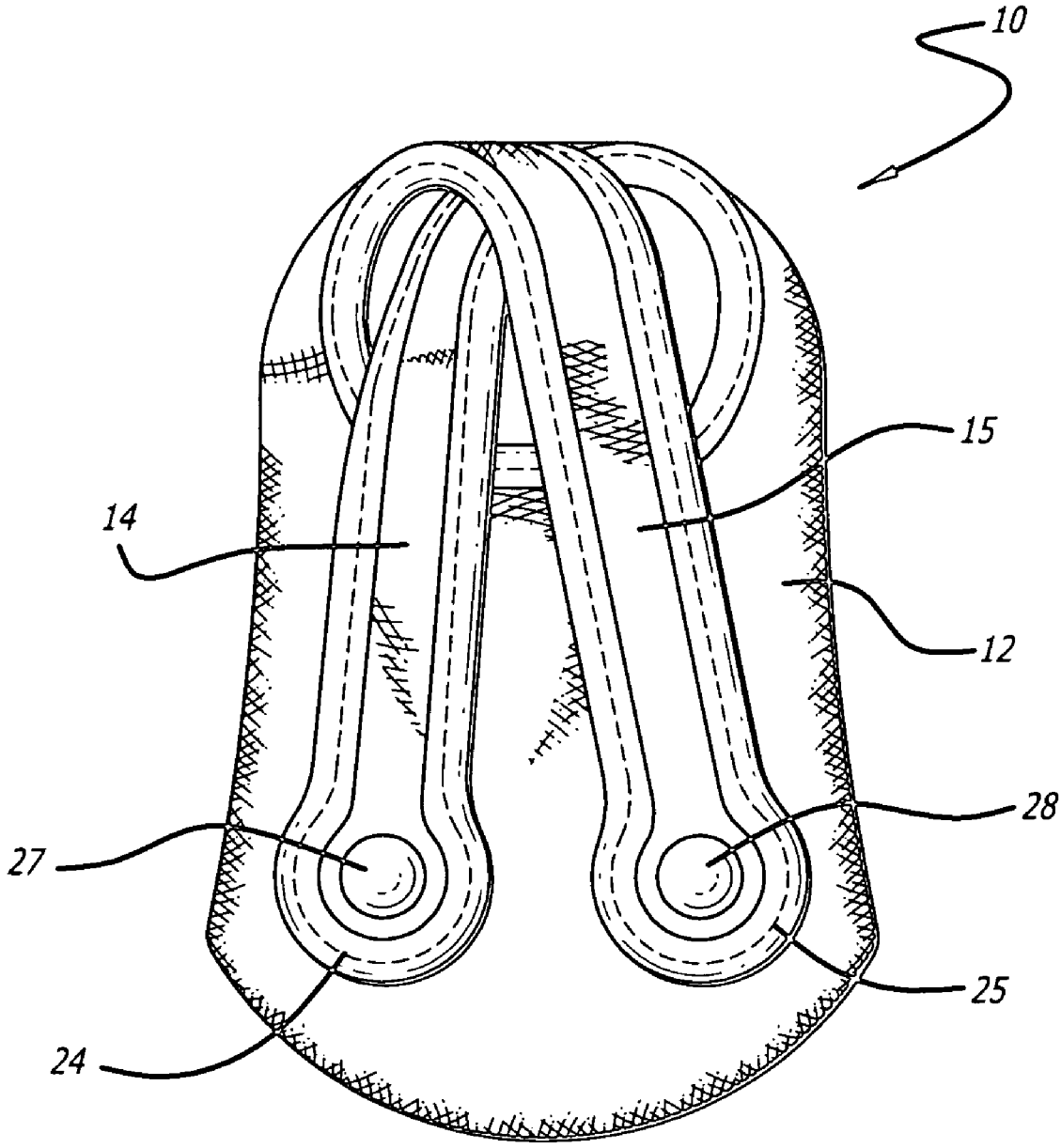
FIG. 8 is a rear elevational view of the carrying case, with the free ends of the straps attached to the rear side of the pouch.

In FIG. 8, strap 15 is shown attached to attachment device 35 and strap 14 is shown attached to attachment device 36, such that straps 14 and 15 cross each other. However, it should be understood that it also is possible to attach strap 14 to attachment device 35 and to attach strap 15 to attachment device 36 and/or to attach only one of strap 14 or 15 to attachment device 35 or 36, depending upon the preferences of the user. Generally speaking, straps 14 and/or 15 will be attached to attachment devices 35 and/or 36 when the user wishes to secure carrying case 10 to a belt or other item. For this purpose, it is also possible to provide a conventional belt clip on the rear side of pouch 12, in addition to or instead of attachment devices 35 and 36. Still further, carrying case 10 may be attached to a belt or other items even in the configuration shown in FIG. 1, with strap 14 and/or 15 looping around the belt or other item while simultaneously going across the top of the cell phone or other device.

In the current embodiment of the invention, only one side (i.e., the inner side) of each proximal end 21 and 22 of straps 14 and 15, respectively, is provided with an attachment device. However, in alternate embodiments both sides may be provided with attachment devices, thereby facilitating additional flexibility in attaching straps 14 and 15 to the various mating devices provided on pouch 12 (without the necessity of twisting such straps).

Figure 2:
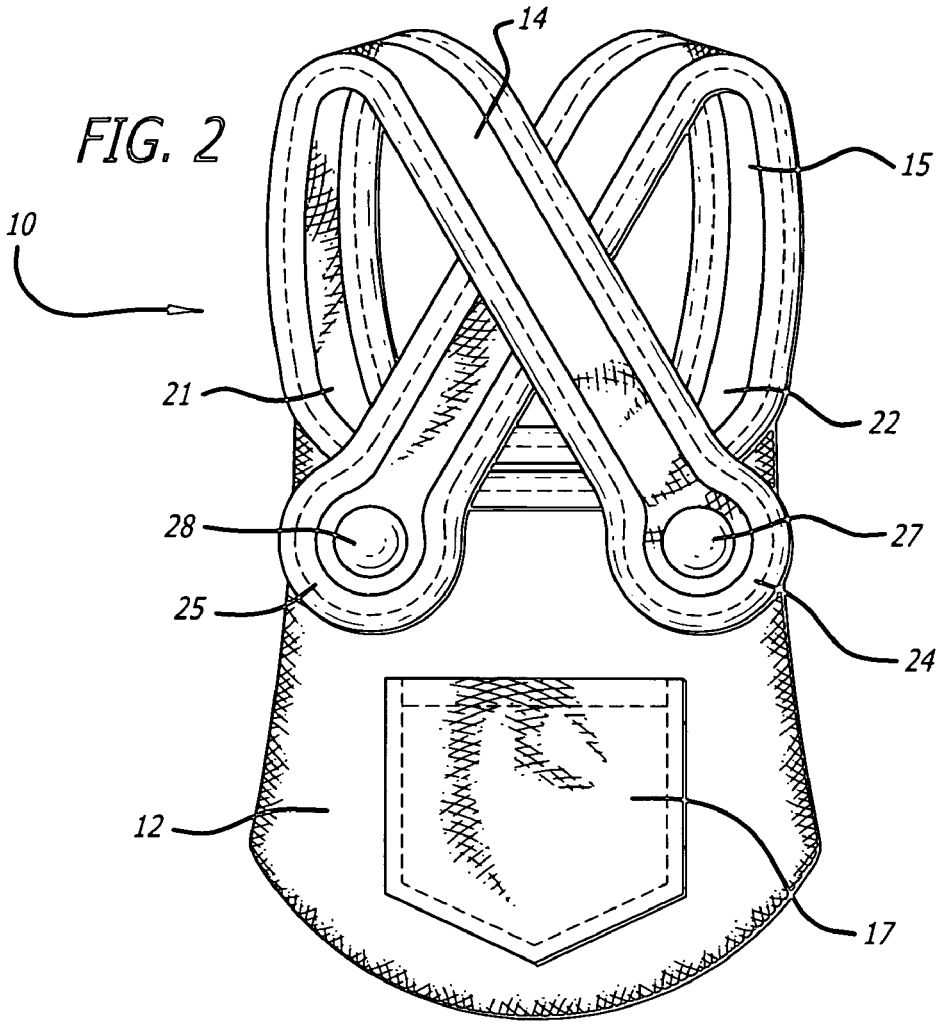
FIG. 2 is a front elevational view of the carrying case.
Figure 3:
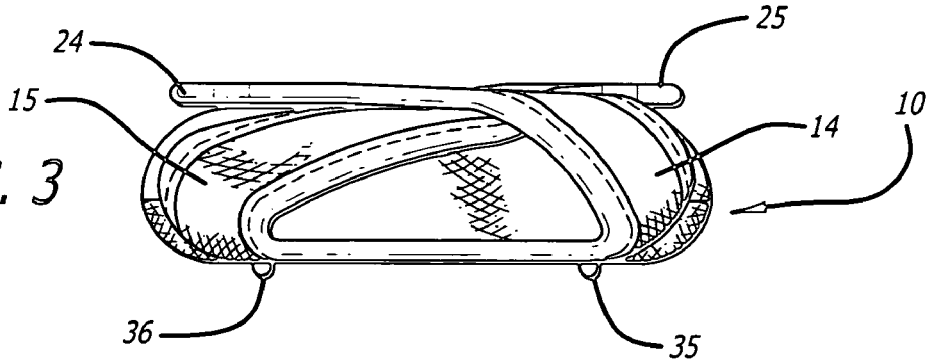
FIG. 3 is a top plan view of the carrying case.
Figure 4:
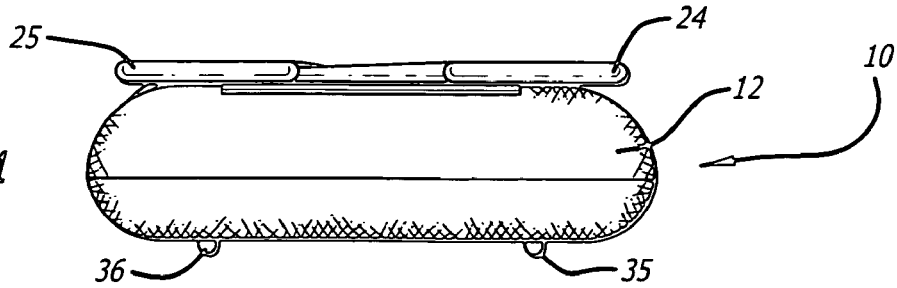
FIG. 4 is a bottom plan view of the carrying case.
Figure 5:
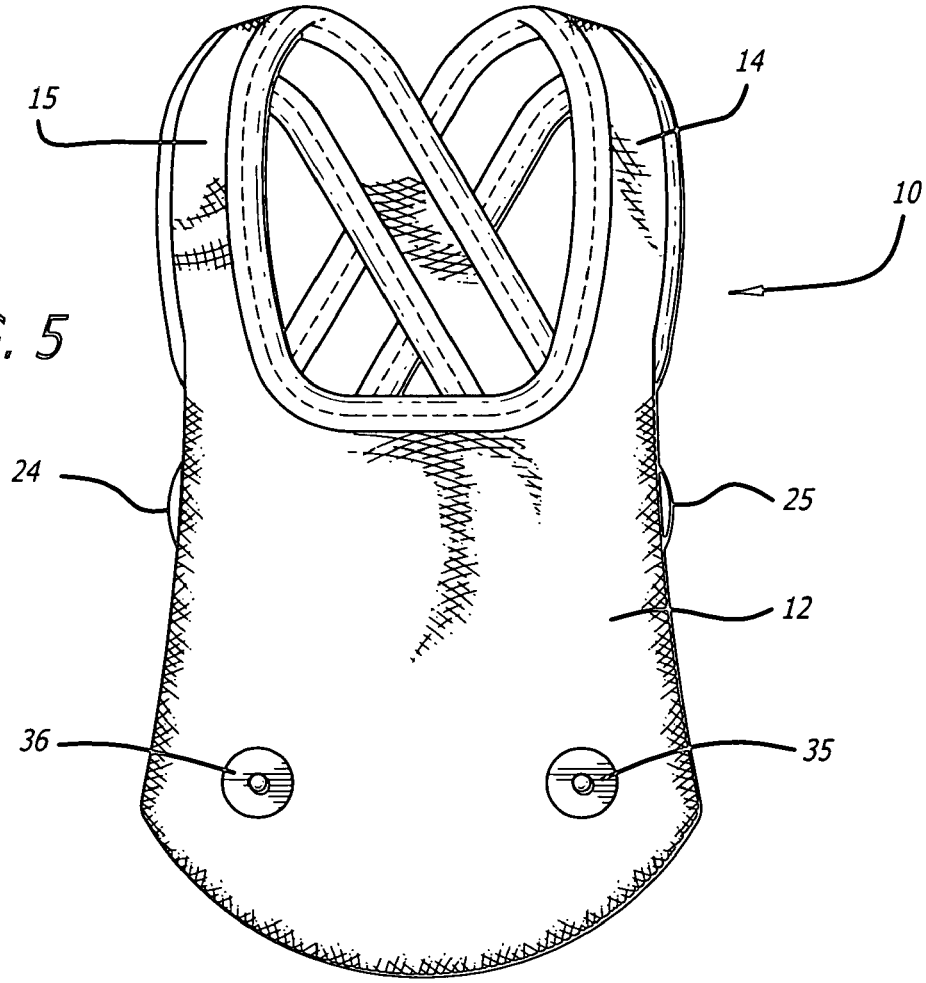
FIG. 5 is a rear elevational view of the carrying case.
Figure 6:
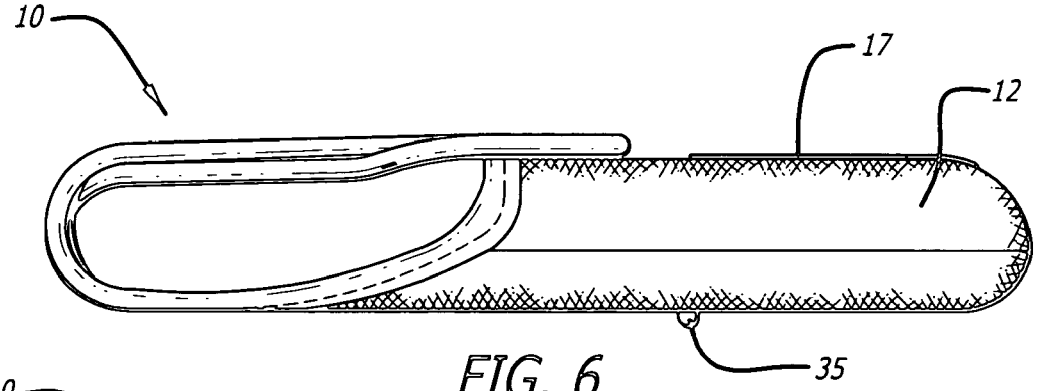
FIG. 6 is a right side elevational view of the carrying case.
Figure 7:
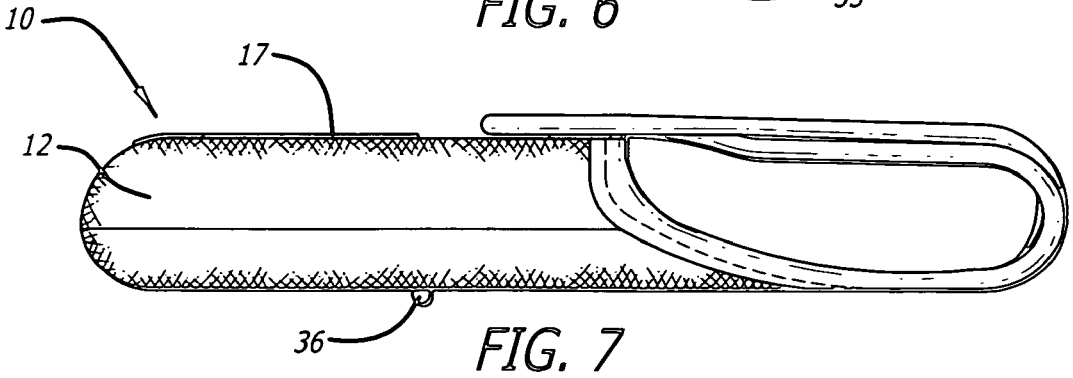
FIG. 7 is a left side elevational view of the carrying case.

As shown in FIGS. 1 and 2, straps 14 and 15 preferably are formed and/or attached to pouch 12 so that they naturally tend to cross over each other when attaching to the front side of pouch 12. However, the distal ends 24 and 25 of straps 14 and 15, respectively, preferably may be attached to pouch 12 in any of a variety of different ways, using any of the provided attachment devices. As a result, the user may use either or both straps 14 and 15: to secure an item within pouch 12 in any of a variety of different ways or as a loop to attach pouch 12 to a belt or other article of clothing. Moreover, if both straps are used to secure the item, either may be released to provide partial access to the item while the item still is secured within pouch 12.

Additional Considerations

Several different variations on the present invention (or embodiments) are described above, with each such embodiment described as including certain features. However, it is intended that the features described in connection with the discussion of any single embodiment are not limited to that embodiment but may be included and/or arranged in various combinations in any of the other embodiments as well, as will be understood by those skilled in the art.

Similarly, in the discussion above, functionality may be ascribed to a particular module or component. However, unless any particular functionality is described above as being critical to the referenced module or component, functionality may be redistributed as desired among any different modules or components, in some cases completely obviating the need for a particular component or module and/or requiring the addition of new components or modules. The precise distribution of functionality preferably is made according to known engineering tradeoffs, with reference to the specific embodiment of the invention, as will be understood by those skilled in the art.

Thus, although the present invention has been described in detail with regard to the exemplary embodiments thereof and accompanying drawings, it should be apparent to those skilled in the art that various adaptations and modifications of the present invention may be accomplished without departing from the spirit and the scope of the invention. Accordingly, the invention is not limited to the precise embodiments shown in the drawings and described above. Rather, it is intended that all such variations not departing from the spirit of the invention be considered as within the scope thereof as limited solely by the claims appended hereto.

What is claimed is:

1. A carrying case, comprising:

(a) a pouch, approximately 1½-3 inches wide and approximately 2-5 inches long, having a front side, a rear side, a left edge and a right edge;

(b) a first strap having a proximal end that is attached to the rear side of the pouch near the right edge and having a distal end that is provided with first attachment means;

(c) a second strap having a proximal end that is attached to the rear side of the pouch near the left edge and having a distal end that is provided with second attachment means;

(d) third attachment means disposed on the front side of the pouch near the right edge;

(e) fourth attachment means disposed on the front side of the pouch near the left edge; and (f) fifth attachment means disposed on the rear side of the pouch;

wherein each of the first attachment means and the second attachment means detachably attaches to the third attachment means, each of the first attachment means and the second attachment means detachably attaches to the fourth attachment means, and each of the first attachment means and the second attachment means detachably attaches to the fifth attachment means.

2. A carrying case according to claim 1, wherein each of the first strap and the second strap is permanently attached to the pouch at its proximal end.

3. A carrying case according to claim 1, wherein each of the third attachment means and the fourth attachment means is disposed near a top edge of the pouch.

4. A carrying case according to claim 1, wherein the first strap is angled so that its distal end naturally tends toward the front left edge of the pouch and the second strap is angled so that its distal end naturally tends toward the front right edge of the pouch.

5. A carrying case according to claim 1, further comprising a pocket on the front side of the pouch.

6. A carrying case according to claim 1, wherein the first attachment means is identical to the second attachment means, and wherein the third attachment means is identical to the fourth attachment means.

7. A carrying case according to claim 1, wherein the pouch, the first strap and the second strap are all comprised of the same material.

8. A carrying case according to claim 1, wherein each of the first attachment means, second attachment means, third attachment means and fourth attachment means comprises at least one of a hook material and a loop material.

9. A carrying case according to claim 1, wherein each of the first attachment means, second attachment means, third attachment means and fourth attachment means comprises a snap fitting.

10. A carrying case according to claim 1, further comprising an electronic device secured within the pouch by the first strap and the second strap.

11. A carrying case according to claim 1, wherein the first attachment means is attached to the fourth attachment means and the second attachment means is attached to the third attachment means so that the first strap and the second strap cross each other.

12. A carrying case according to claim 1, wherein each of the first strap and the second strap is approximately 4-6 inches long.

13. A carrying case according to claim 1, wherein the combined width of the first strap and the second strap is substantially smaller than the width of the pouch.

14. A carrying case according to claim 1, further comprising sixth attachment means, wherein the fifth attachment means is disposed beneath the proximal end of the first strap and the sixth attachment means is disposed on the rear side of the pouch beneath the proximal end of the second strap, and wherein each of the first attachment means and the second attachment means detachably attaches to the sixth attachment means.

15. A carrying case according to claim 14, wherein each of the first strap and the second strap is permanently attached to the pouch at its proximal end.

16. A carrying case according to claim 14, wherein each of the third attachment means and the fourth attachment means is disposed near a top edge of the pouch.

17. A carrying case according to claim 14, wherein the first strap is angled so that its distal end naturally tends toward the front left edge of the pouch and the second strap is angled so that its distal end naturally tends toward the front right edge of the pouch.

18. A carrying case according to claim 14, wherein the pouch, the first strap and the second strap are all comprised of the same material.

19. A carrying case according to claim 14, wherein the third attachment means, the fourth attachment means, the fifth attachment means and the sixth attachment means are all identical to each other.

20. A carrying case according to claim 14, wherein the first attachment means is attached to the sixth attachment means and the second attachment means is attached to the fifth attachment means so that the first strap and the second strap cross each other.

* * * * *